US005566469A

United States Patent [19]

Bolton et al.

[11] Patent Number: 5,566,469

[45] Date of Patent: Oct. 22, 1996

[54] DRYING APPARATUS WITH ROTATABLE HOUSING

[75] Inventors: Danny R. Bolton, Brownwood; David L. Bigham, Novice, both of Tex.

[73] Assignee: Fen-Tech Environmental, Inc., Brownwood, Tex.

[21] Appl. No.: 503,475

[22] Filed: Jul. 18, 1995

[51] Int. Cl.[6] ..... F26B 11/04

[52] U.S. Cl. ..... 34/135; 34/136; 34/182

[58] Field of Search ..... 34/135, 136, 137, 34/182

[56] References Cited

U.S. PATENT DOCUMENTS

| | | | |
|---|---|---|---|
| 1,318,133 | 10/1919 | Christie . | |
| 2,069,164 | 1/1937 | Vogel-Jorgensen | 34/135 |
| 2,311,824 | 2/1943 | Gautreau | 34/135 |
| 3,494,049 | 2/1970 | Likness | 34/137 |
| 4,181,846 | 1/1980 | Cunningham . | |
| 4,649,655 | 3/1987 | Witten | 34/135 |
| 4,656,759 | 4/1987 | Yamato | 34/135 |
| 4,854,941 | 8/1989 | Chedgy . | |
| 5,197,205 | 3/1993 | Spada et al. . | |
| 5,244,274 | 9/1993 | Onodera | 34/135 |
| 5,318,049 | 6/1994 | Henderson et al. | 34/137 |

*Primary Examiner*—F. Daniel Lopez
*Assistant Examiner*—Michael S. Lee
*Attorney, Agent, or Firm*—Daniel V. Thompson

[57] ABSTRACT

A thermal vaporization apparatus includes a cylindrical tube having two ends. A base is provided, with the tube being rotatable with respect to the base. A first drive mechanism applies rotating force to the tube. An auger having two ends extends through the tube, and a second drive mechanism applies rotating force to the auger. At least one gas-fired burner to heat the exterior of the tube while in rotation is provided. A feed mechanism for introducing wet material into the interior of the tube and exterior of the auger within the tube is also provided.

10 Claims, 4 Drawing Sheets

DRYING APPARATUS WITH ROTATABLE HOUSING

REFERENCE TO DISCLOSURE DOCUMENT

Reference is made to Disclosure Document No. 358,432, dated Jul. 25, 1994.

1. Field of the Invention

This invention relates to drying machines, and more particularly, to rotary heaters with augers for material conveying.

2. Background Art

The disposal of wastes having thermally vaporizable liquid components is of increasing concern due to ever tighter environmental regulations. Sources of such wastes are municipal, petro-chemical, paper industries, food industries, agricultural, remedial clean-up activities, and general industrial sources.

SUMMARY OF THE INVENTION

The present invention provides a thermal vaporization apparatus having a cylindrical tube heated by one or more gas-fired burners. The tube is rotatable with respect to a base. An auger within the tube is also rotatable. The combination of rotating both the tube and the auger provides enhanced vaporization performance.

BRIEF DESCRIPTION OF THE DRAWINGS

A more complete understanding of the invention and its advantages will be apparent from a review of the Detailed Description in conjunction with the following Drawings, in which.

DETAILED DESCRIPTION

Figure 1:
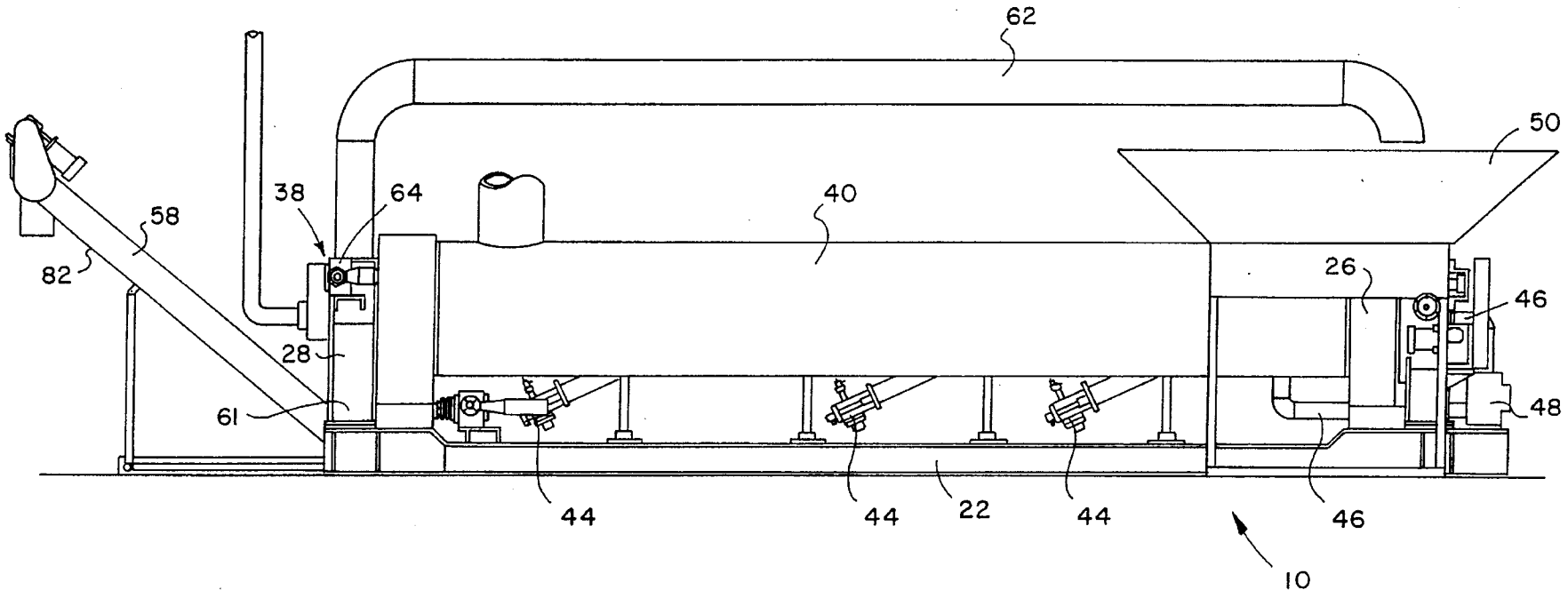
FIG. 1 is a side view of the apparatus.
Figure 2:
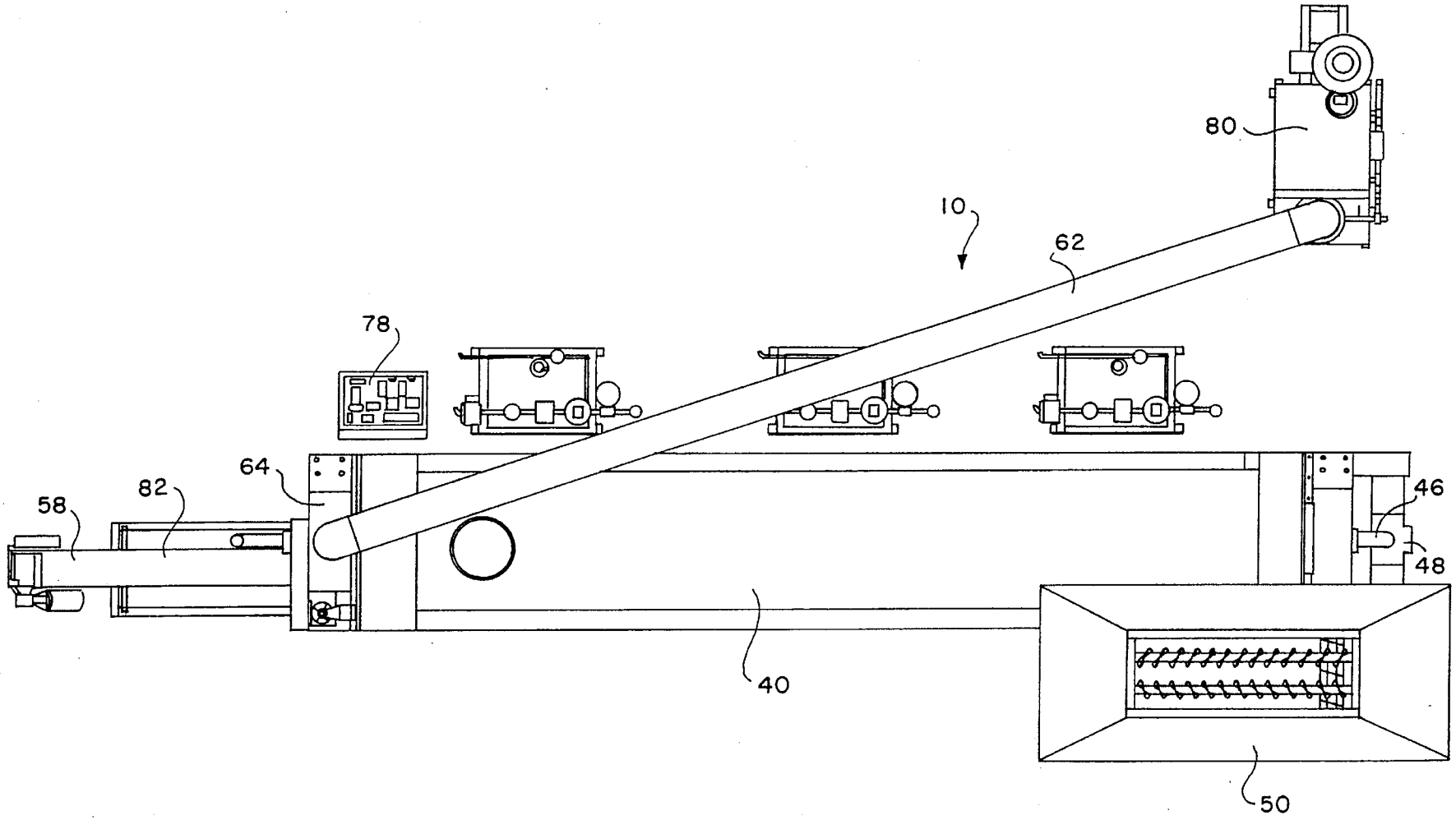
FIG. 2 is an overhead view of the apparatus.
Figure 3:
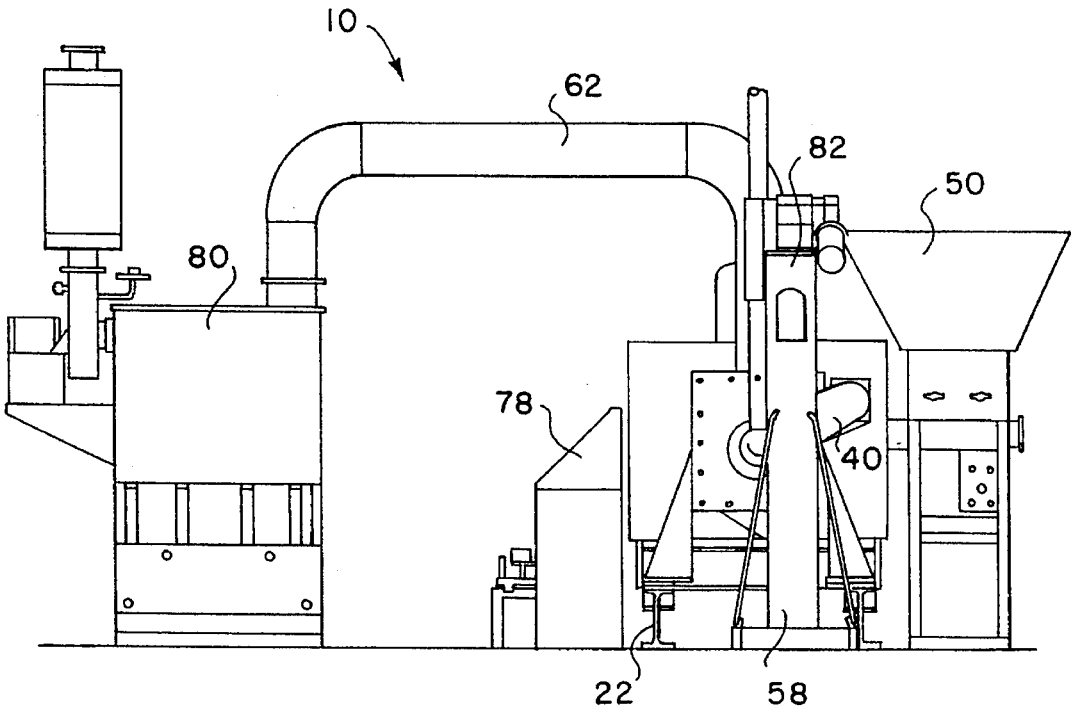
FIGS. 3 and 4 are end views of the apparatus.
Figure 4:
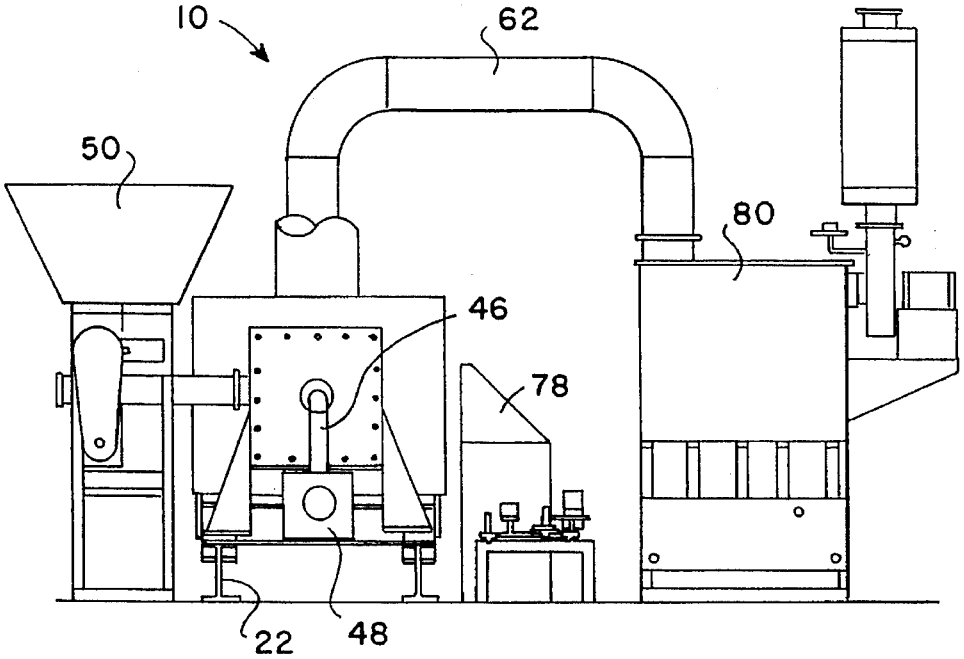
Figure 5:
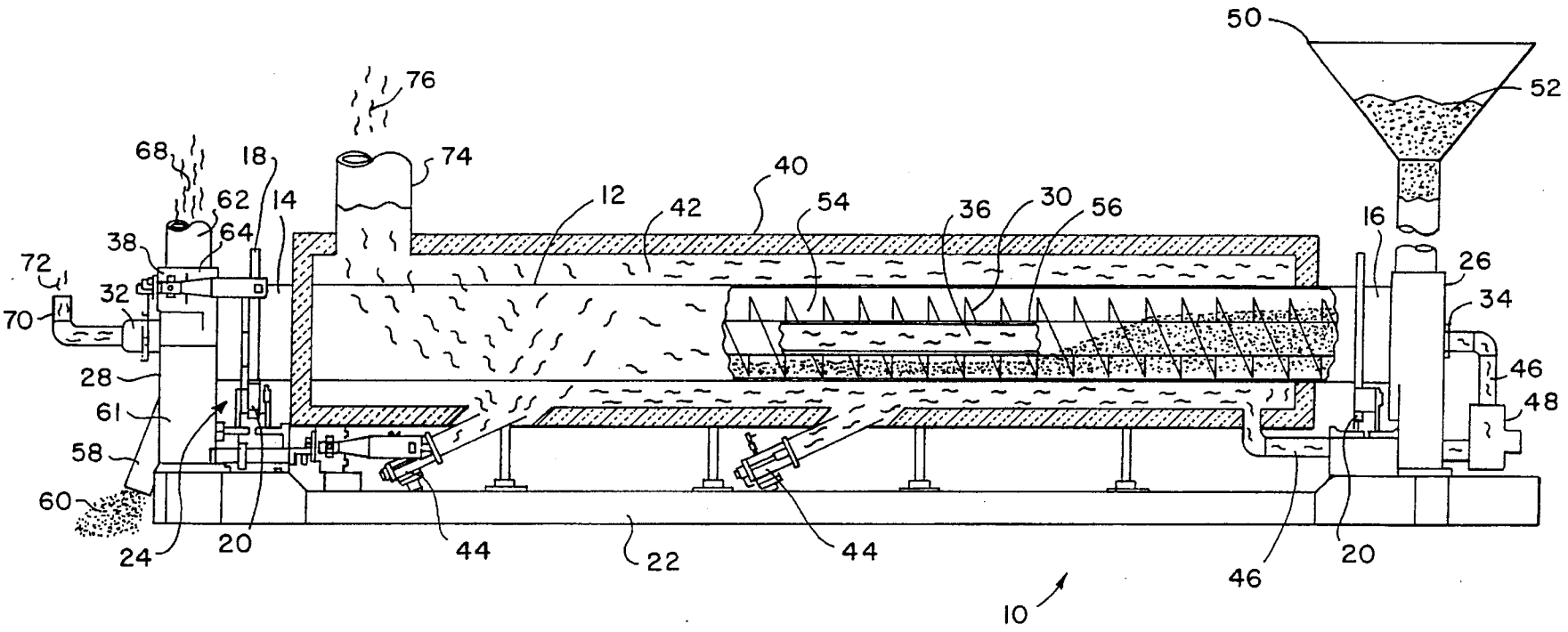
FIG. 5 is a partially broken away schematic side view of the apparatus in operation.

Referring initially to FIGS. 1–5, where like numerals indicate like and corresponding elements, apparatus 10 includes a cylindrical tube 12 having two ends 14 and 16. Tube 12 has at least one support wheel 18 at each end 14, 16. Rollers 20 are rotatably mounted to base 22, with the rollers 20 contacting the tube support wheels 18 in a supporting relationship, such that the tube 12 is rotatable with respect to base 22. First drive means 24 applies rotating force to the tube 12, and includes appropriate chains, sprockets, a gear reduction unit and a variable speed DC electric motor.

A stationary wet material input chamber 26 is fixed to base 22 at one end 16 of tube 12. A stationary dried material and product vapor discharge chamber 28 is fixed to base 22 at the other end 14 of tube 12. The ends 14, 16 of tube 12 extend into their associated chambers 28, 26. High temperature seals (not shown) at the ends 14, 16 prevent leakage of material and vapors.

Auger 30 has two ends 32 and 34. Auger 30 extends through tube 12 and the stationary chambers 26, 28. Auger 30 has a hollow central shaft 36 and is rotatably mounted within tube 12 and supported for rotation by the chambers 26 and 28 at each end 34, 32.

Second drive means 38 applies rotating force to auger 30, and includes appropriate chains, sprockets, a gear reduction unit and a variable speed electric motor.

An insulated cover 40 for tube 12 is sized to provide an annular space 42 within the cover 40 about the tube 12. A plurality of gas-fired burners 44 are in communication with the annulus 42 to heat the exterior 44 of the tube 12.

In the preferred embodiment, conduit 46 connects the annulus 42 to the end 34 of the auger hollow shaft 36 at the wet material input chamber 26 by way of a blower 48. In some applications, the advantages of the invention may be obtained without the use of a conduit 46.

Feed means 50 iS provided to introduce wet material 52 into the wet material input chamber 26 and thereby into the interior annulus 54 of tube 12 and the exterior 56 of auger 30.

Discharge means 58 is provided to receive dried material 60 at the bottom end 61 of the dried material and product vapor discharge chamber 28.

First vent means 62 is connected to the top 64 of the dried material and product vapor discharge chamber 28 for exhausting fumes 68 from the tube 12 and chamber 28. Second vent means 70 is connected to the end 32 of the auger hollow shaft 36 at the dried material and product vapor discharge chamber 28 for exhausting combustion gases 72. A third vent means 74 exhausts the remaining combustion gases 76.

A control panel 78 provides for burner and DC motor speed control. Air treatment apparatus 80 may be optionally provided at the discharge of first vent means 62. Conveyor 82 may be optionally provided for handling dried material produced by the apparatus.

In operation, apparatus 10 has as its main component cylindrical tube 12 which has large diameter steel support wheels 18 on both ends. These wheels 18 are positioned on rollers 20 mounted to the base 22 to allow the rotation of the dehydration chamber provided by tube 12. The chamber is driven with chains and sprocketing attached to a gear reduction unit and powered by a variable speed DC motor. Both the "wet end" (wet material input chamber 26) and the "dry end" (dried material and product vapor discharge chamber 28) are stationary chambers. The dehydration chamber extends into these chambers. High temperature seals located on either end around the chambers prevent leakage of the material and vapors.

Extending through the center of the dehydration chamber and stationary ends is a specially-manufactured screw auger with flights positioned on a hollow shaft 36. This auger 30 is also driven with chains and sprocketing attached to a gear reduction unit powered by a variable speed DC motor. The rotating dryer chamber is housed inside the insulated metal cover 40 with several inches of air spacing left between the insulation and the tube 12. Heat from the gas-fired burners 44 is introduced into this annulus through a plenum located in the lower section of annulus 42 before being exhausted to the atmosphere. This method allows the slow rotating chamber to be heated uniformly around the entire diameter. When required, a portion of the hot combustion gases may be drawn from the annulus 42 by a blower 48 and injected into the "wet end" of the hollow auger shaft 36. These are also exhausted to the atmosphere at the "dry end" of the system.

The material 52 to be dehydrated can be metered into the chamber 26 by either a variable speed screw auger or metering pump. The wet material is subjected to the indirect heat of the chamber walls and, if desired, the heated hollow auger shaft. The dried material 60 is discharged out of the dryer tube through the bottom of the "dry end" stationary chamber. The vapors coming off of the product are exhausted out the top of this end. The type and make-up of the material and the air quality regulatory agency requirements that must be met in specific areas will determine what type of air-handling equipment 80, if any, will be required.

Whereas, the present invention has been described with respect to a specific embodiment thereof, it will be understood that various changes and modifications will be suggested to one skilled in the art and it is intended to encompass such changes and modifications as fall within the scope of the appended claims.

We claim:

1. Thermal vaporization apparatus, comprising:

a cylindrical tube having two ends;

a base, with the tube being rotatable with respect to the base;

first drive means for applying rotating force to the tube;

an auger having two ends and extending through the tube;

second drive means for applying rotating force to the auger;

at least one heating means to heat the exterior of the tube while in rotation;

feed means for introducing wet material into the interior of the tube and exterior of the auger within the tube; and with a stationary wet material input chamber fixed to the base at one end of the tube, and a stationary dried material and product vapor discharge chamber fixed to the base at the other end of the tube, and the ends of the tube extending into their associated chambers.

2. The apparatus of claim 1 with high temperature seals at the ends to prevent leakage of material and vapors.

3. The apparatus of claim 1 with the auger extending through the tube and stationary chambers.

4. The apparatus of claim 3 with the auger supported for rotation by the chambers at each end.

5. The apparatus of claim 1 with discharge means for receiving dried material at a bottom end of the dried material and product vapor discharge chamber.

6. The apparatus of claim 1 with first vent means connected to the top of the dried material and product vapor discharge chamber for exhausting fumes from the tube and said chamber.

7. The apparatus of claim 1 with the auger having a hollow central shaft, and with second vent means connected to the end of the auger hollow shaft at the dried material and product vapor discharge chamber for exhausting combustion gasses.

8. Thermal vaporization apparatus, comprising:

a cylindrical tube having two ends;

a base, with the tube being rotatable with respect to the base;

first drive means for applying rotating force to the tube;

an auger having two ends and extending through the tube;

second drive means for applying rotating force to the auger;

at least one heating means to heat the exterior of the tube while in rotation; and feed means for introducing wet material into the interior of the tube and exterior of the auger within the tube;

with an insulated cover for the tube sized to provide an annular space within the cover about the tube; and with the heating means in communication with the annular space.

9. The apparatus of claim 8 with the auger having a hollow central shaft, and a conduit connecting the annulus to the end of the auger hollow shaft.

10. Thermal vaporization apparatus, comprising:

a cylindrical tube having two ends;

the tube having at least one support wheel fixed to each end of the tube;

rollers rotatably mounted to a base, with the rollers contacting the tube support wheels in a supporting relationship, such that the tube is rotatable with respect to the base;

first drive means for applying rotating force to the tube, including chains, sprockets, a gear reduction unit and a variable speed electric motor;

a stationary wet material input chamber fixed to the base at one end of the tube, and a stationary dried material and product vapor discharge chamber fixed to the base at the other end of the tube, the ends of the tube extending into their associated chambers, with high temperature seals at the ends to prevent leakage of material and vapors;

an auger having two ends and extending through the tube and stationary chambers, the auger having a hollow central shaft and being rotatably mounted within the tube and supported for rotation by the chambers at each end;

second drive means for applying rotating force to the auger, including chains, sprockets, a gear reduction unit and a variable speed electric motor;

an insulated cover for the tube sized to provide an annular space within the cover about the tube;

a plurality of gas-fired burners in communication with the annulus to heat the exterior of the tube;

a conduit connecting the annulus to the end of the auger hollow shaft at the wet material input chamber by way of a blower;

feed means for introducing wet material into the wet material input chamber and thereby to the interior of the tube and exterior of the auger within the tube;

discharge means for receiving dried material at a bottom end of the dried material and product vapor discharge chamber;

first vent means connected to the top of the dried material and product vapor discharge chamber for exhausting fumes from the tube and said chamber; and second vent means connected to the end of the auger hollow shaft at the dried material and product vapor discharge chamber for exhausting combustion gases.

* * * * *